United States Patent [19]

Giannaula et al.

[11] 4,218,110

[45] Aug. 19, 1980

[54] CONNECTOR-TO-CONNECTOR ADAPTOR

[75] Inventors: Joseph J. Giannaula, Ladson, S.C.; Kenneth P. Reever, Pittsfield, Mass.

[73] Assignee: The United States of America as represented by the Secretary of the Navy, Washington, D.C.

[21] Appl. No.: 26,982

[22] Filed: Apr. 4, 1979

[51] Int. Cl.[2] ..... H01R 23/02

[52] U.S. Cl. ..... 339/154 A; 339/89 M

[58] Field of Search ..... 339/18 P, 89 R, 89 M, 339/90 R, 92 R, 92 M, 31 R, 63 M, 154 R, 154 A, 156 R, 157 R, 166 R

[56] References Cited

U.S. PATENT DOCUMENTS 3,281,558 10/1966 Weber ..... 339/157 R X 3,302,475 5/1968 Kramer ..... 339/154 A X

FOREIGN PATENT DOCUMENTS 463631 10/1926 Fed. Rep. of Germany ..... 339/18 P 1094473 12/1967 United Kingdom ..... 339/154 R

*Primary Examiner*—Roy Lake

*Assistant Examiner*—Eugene F. Desmond

*Attorney, Agent, or Firm*—R. S. Sciascia; Charles D. B. Curry; Francis I. Gray

[57] ABSTRACT

A connector-to-connector adaptor which permits the adaptation from one connector interface to another connector interface without modification of electrical equipment interfaces. An adaptor shell has a plurality of contact shafts which replace the respective contacts of the dissimilar connectors to be joined. The adaptor shell is joined to one connector and the contact shafts are inserted first into the openings of one connector and then the other connector. Finally the adaptor shell is joined to the other connector. A pin is integrally connected to one end of the contact shaft and a socket contact with retention means is integrally connected to the other end.

5 Claims, 3 Drawing Figures

CONNECTOR-TO-CONNECTOR ADAPTOR

BACKGROUND OF THE INVENTION

1. Field of the Invention

The present invention relates to electrical connectors, and more particularly to a connector-to-connector adaptor.

2. Description of Prior Art

In the design of large, complex pieces of hardware such as an aerospace vehicle, airplane or the like many contractors make contributions to the final product. In the interests of economy it is desirable to procure off-the-shelf items wherever possible. However, where electrical components are provided by different contractors, the electrical connector interfaces may not be compatible. Therefore, it is desirable to adapt one connector to another connector without the need for costly modifications in design of one connector or the other.

SUMMARY OF THE INVENTION

Accordingly, the present invention provides a connector-to-connector adaptor which permits the adaptation from one connector interface to another connector interface without modification of electrical equipment interfaces. An adaptor shell has a plurality of contact shafts which replace the respective contacts of the dissimilar connectors to be joined. The adaptor shell is joined to one connector and the contact shafts are inserted first into the openings of one connector and then the other connector. Finally the adaptor shell is joined to the other connector. A pin is integrally connected to one end of the contact shaft and a socket contact with retention means is integrally connected to the other end.

Therefore, it is an object of the present invention to provide an electrical interface between two dissimilar connectors without costly modification of either connector.

Another object of the present invention is to provide a connector-to-connector adaptor for high density connectors of different types.

Other objects, advantages and novel features of the present invention will be apparent from the following detailed description when read in conjunction with the appended claims and attached drawing.

DESCRIPTION OF THE PREFERRED EMBODIMENT

Figure 1:
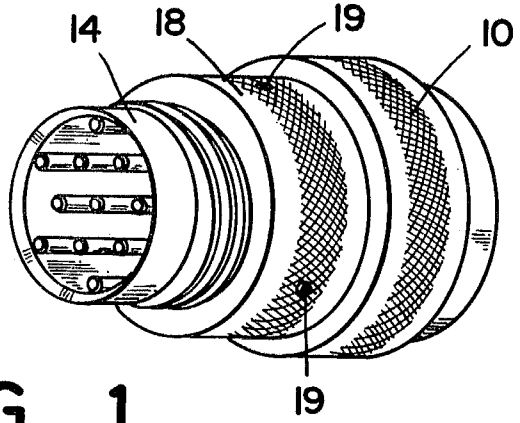
FIG. 1 is a perspective view of the connector-to-connector adaptor.
Figure 2:
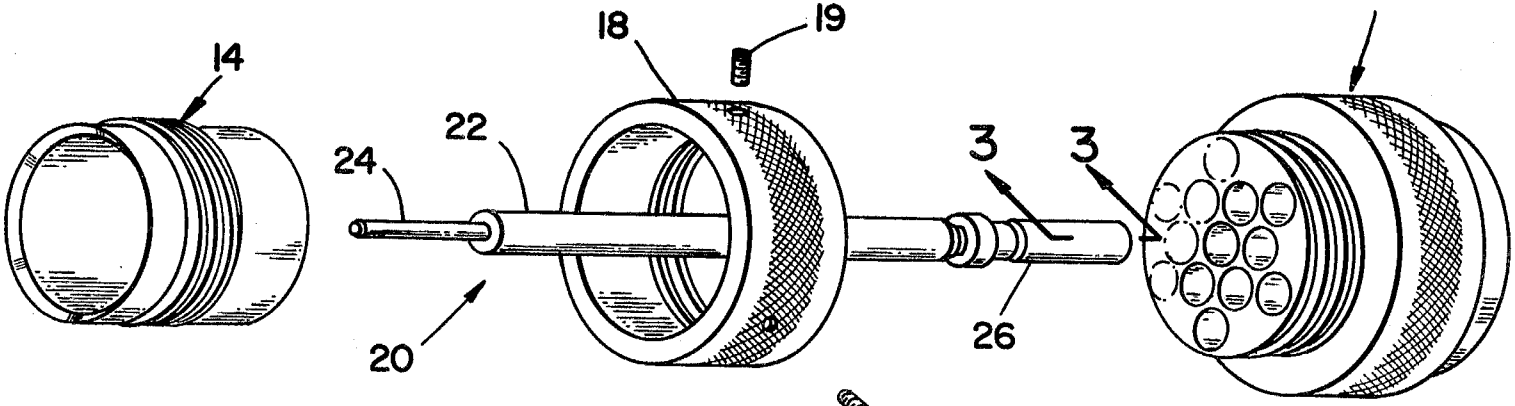
FIG. 2 is an exploded view of the connector-to-connector adaptor of FIG. 1.
Figure 3:
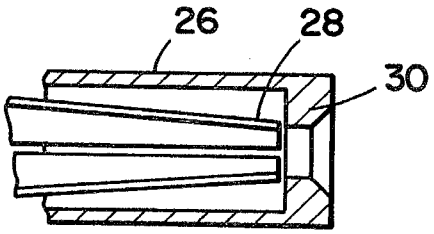
FIG. 3 is a cross-sectional view of the end of the socket contact of the electrical contact of FIG. 2 taken along line 3—3.

Referring now to FIGS. 1–3 a first connector 10 having openings for female sockets is to be joined with a second connector 14 having openings for male pins. An adaptor ring or shell 18 is used to join the second connector 14 with the first connector 10. The adaptor shell 18 may be threadedly secured to one connector and be secured by set screws 19 to the other connector.

A plurality of contacts 20 each have a shaft 22 with an integral pin 24 at one end and an integral socket 26 at the other end. The integral pin 24 is machined to fit the opening of the first connector 10, and the integral socket 26 is configured to fit the openings of the second connector 14. Internal to the integral sockets 26 is a segmented leaf spring 28 to firmly retain pins inserted therein. A hood 30 integral with the integral socket 26 protects the leaf spring.

In operation the adaptor ring 18 is threadedly connected to the first connector 10 and the socket ends 26 of the contacts 20 are inserted into the openings. The pin ends 24 of the contacts 20 are then inserted into the openings of the second connector 14. The set screws 19 are tightened to secure the adaptor ring 18 to the second connector 14. The contacts 20 which replace the regular conductors of the first and second connector 10, 14 may be exchanged for other contacts having different diameter pins depending upon the connectors being mated.

Thus, the present invention provides a connector-to-connector adaptor for a positive mating of mismatched connectors without the necessity of an expensive redesign of one or the other of the connectors.

What is claimed is:

1. A connector-to-connector adaptor for positively mating a first connector to a mismatched second connector comprising:

(a) an adaptor shell having a first means for engaging said first connector and having a second means for engaging said second connector; and (b) a plurality of contacts contained within said adaptor shell, each of said contacts having a pin end to enter openings of said first connector and having a socket end to enter openings of said second connector to form the contacts for both said first and said second connectors.

2. A connector-to-connector adaptor as recited in claim 1 further comprising means for positively retaining connecting electrical pins within said socket end.

3. A connector-to-connector adaptor as recited in claim 2 wherein said retaining means comprises a segmented leaf spring located within said socket end, said socket end having a hood to retain said segmented leaf spring therein.

4. A connector-to-connector adaptor as recited in claims 1 or 3 wherein said first and second engaging means comprise a threaded entry and a plurality of set screws, respectively.

5. A method for positively mating a first connector to a mismatched second connector comprising the steps of:

(1) joining an adaptor shell to said first connector by a first engaging means;

(b) inserting first ends of a plurality of contacts into the contact openings of said first connector, said contacts having a shaft with and integral pin at one end and an integral socket at the other end;

(c) inserting the other ends of said plurality of contacts into contact openings of said second connector to form an integral contact common to both of said connectors; and (d) joining said adaptor shell to said second connector by a second engaging means.

* * * * *